US009108408B2

(12) United States Patent
Oguchi

(10) Patent No.: US 9,108,408 B2
(45) Date of Patent: Aug. 18, 2015

(54) INKJET RECORDING APPARATUS

(71) Applicant: Brother Kogyo Kabushiki Kaisha, Nagoya-shi, Aichi-ken (JP)

(72) Inventor: Tomoya Oguchi, Nishikasugai-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/340,812

(22) Filed: Jul. 25, 2014

(65) Prior Publication Data

US 2015/0029244 A1 Jan. 29, 2015

(30) Foreign Application Priority Data

Jul. 26, 2013 (JP) ..... 2013-155222

(51) Int. Cl.
*B41J 2/195* (2006.01)
*B41J 2/165* (2006.01)

(52) U.S. Cl.
CPC .... *B41J 2/16523* (2013.01); *B41J 2002/16594* (2013.01)

(58) Field of Classification Search
CPC ..... B41J 2/17566; B41J 2/17513; B41J 2/17546; B41J 2/17509; B41J 2/1752
USPC ..... 347/7, 29, 30, 34
See application file for complete search history.

(56) References Cited

U.S. PATENT DOCUMENTS

| | | | | |
|---|---|---|---|---|
| 5,147,418 | A * | 9/1992 | Laverman et al. | 95/90 |
| 2005/0264619 | A1* | 12/2005 | Walton et al. | 347/84 |
| 2007/0042111 | A1* | 2/2007 | Koyama | 427/64 |
| 2007/0127063 | A1* | 6/2007 | Fertlitsch et al. | 358/1.15 |
| 2011/0050799 | A1* | 3/2011 | Nishida | 347/30 |
| 2012/0050421 | A1* | 3/2012 | Hamasaki et al. | 347/85 |

FOREIGN PATENT DOCUMENTS

| | | | |
|---|---|---|---|
| JP | H11-138858 | A | 5/1999 |
| JP | 2005-254791 | A | 9/2005 |
| JP | 2006-142575 | A | 6/2006 |
| JP | 2007-098777 | A | 4/2007 |

* cited by examiner

*Primary Examiner* — Manish S Shah
*Assistant Examiner* — Yaovi Ameh
(74) *Attorney, Agent, or Firm* — Banner & Witcoff, Ltd.

(57) ABSTRACT

An inkjet recording apparatus may include a carriage, a recording head mounted on the carriage and including a nozzle surface, a maintenance mechanism, and a controller. The maintenance mechanism may include a cap which covers, in a covering position, the nozzle surface of the recording head, a pump including an inlet and an outlet, a tube extending from the outlet, and a waste ink storage detachably attached to the tube. The controller drives the pump to execute purging with the inlet of the pump in communication with the cap in the covering position, receives an input indicating replacement of the waste ink storage, and drives the pump to execute an idle suction with the inlet of the pump in communication with atmosphere when a time elapsed after the execution of the purging until the reception of the input is shorter than a threshold time.

10 Claims, 10 Drawing Sheets

INKJET RECORDING APPARATUS

CROSS-REFERENCE TO RELATED APPLICATION

This application claims priority from Japanese Patent Application No. 2013-155222, filed on Jul. 26, 2013, which is incorporated herein by reference in its entirety.

TECHNICAL FIELD

Aspects disclosed herein relate to an inkjet recording apparatus comprising a maintenance mechanism for sucking ink from a recording head.

BACKGROUND

Known inkjet recording apparatuses eject ink onto one or more sheets to record one or more images thereon. Some of the inkjet recording apparatuses comprise a maintenance mechanism for maintaining conditions of ink stored in a recording head appropriately. The maintenance mechanism comprises, for example, a cap for covering a nozzle surface of the recording head, a pump for sucking ink from the nozzle surface via the cap, and a waste ink storage for storing ink sucked by the pump.

SUMMARY

Aspects of the disclosure provide for an inkjet recording apparatus that may effectively reduce splattering of ink during replacement of a waste ink storage without increasing a parts count of the inkjet recording apparatus.

According to one or more aspects of the disclosure, an inkjet recording apparatus may comprise a carriage configured to move in a main scanning direction, a recording head mounted on the carriage and comprising a nozzle surface in which nozzles are formed, a maintenance mechanism configured to discharge the ink from the recording head, and a controller. The recording head is configured to eject ink through the nozzles. The maintenance mechanism may comprise a cap disposed to face the carriage positioned in a maintenance area, a pump comprising an inlet and an outlet and configured to be driven to discharge the ink from the recording head through the inlet to the outlet, a tube extending from the outlet of the pump, and a waste ink storage detachably attached to an end of the tube and configured to store the ink discharged from the recording head. The cap is configured to move between a covering position in which the cap covers the nozzle surface of the recording head and a separate position in which the cap is separate from the nozzle surface. The controller is configured to drive the pump to execute purging in a state in which the inlet of the pump in communication with the cap in the covering position, to receive an input indicating replacement of the waste ink storage, and to drive the pump to execute a first idle suction in a state in which the inlet of the pump in communication with atmosphere when a time elapsed after the execution of the purging until the reception of the input is shorter than a threshold time.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Figure 1:
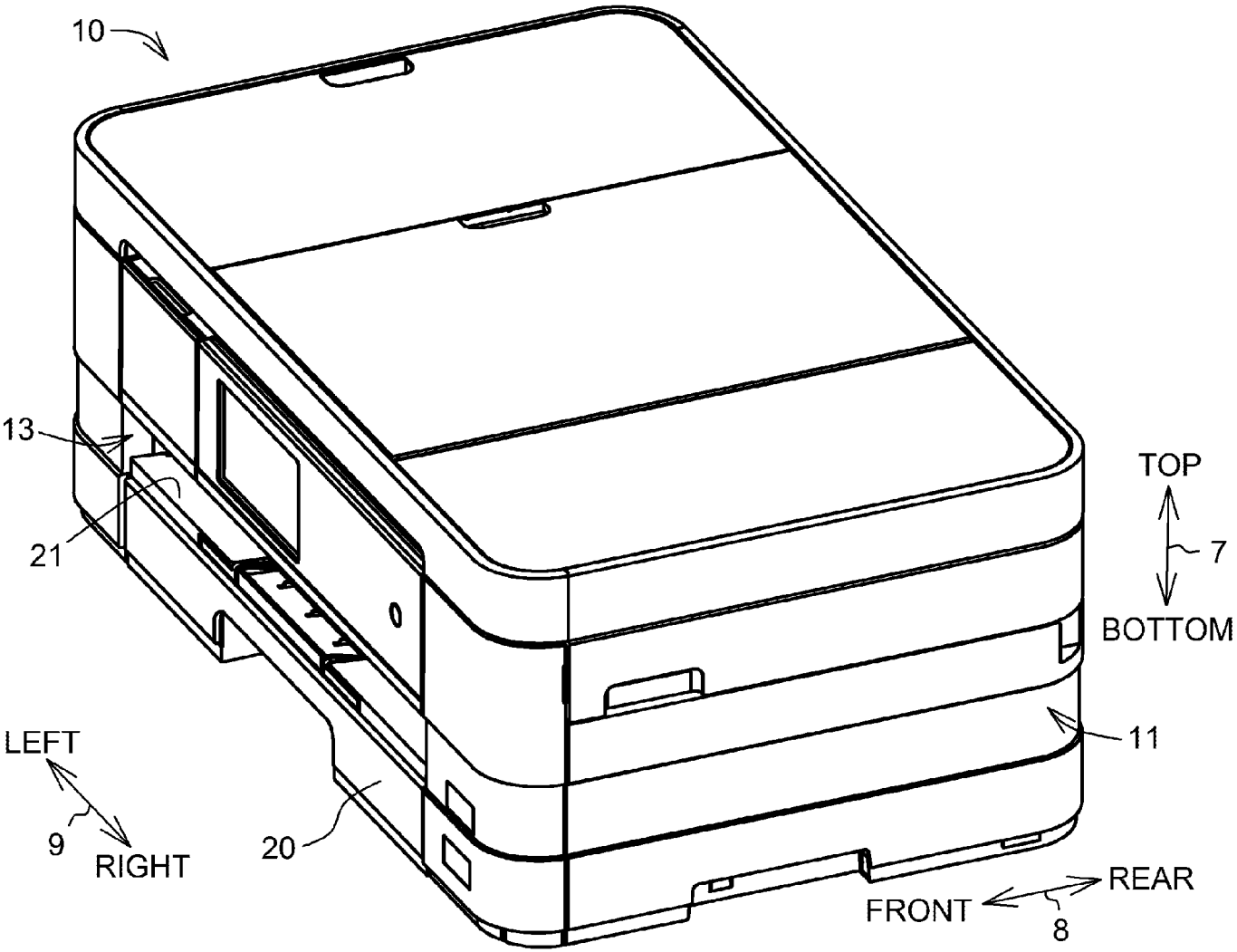
FIG. 1 is a perspective view depicting an appearance of a multifunction device in an illustrative embodiment according to one or more aspects of the disclosure.

An illustrative embodiment according to one or more aspects will be described below with reference to the accompanying drawings. The illustrative embodiment described below is merely an example. Various changes, arrangements and modifications may be applied therein without departing from the spirit and scope of the disclosure. In the description below, a top-bottom direction 7 is defined with reference to an orientation of a multifunction device 10 that is disposed in an orientation in which it is intended to be used (e.g., an orientation depicted in FIG. 1). A side of the multifunction device 10, in which an opening 13 is defined, is defined as the front of the multifunction device 10. A front-rear direction 8 is defined with reference to the front of the multifunction device 10. A right-left direction 9 is defined with respect to the multifunction device 10 as viewed from its front.

Overall Configuration of Multifunction Device 10

Figure 2:
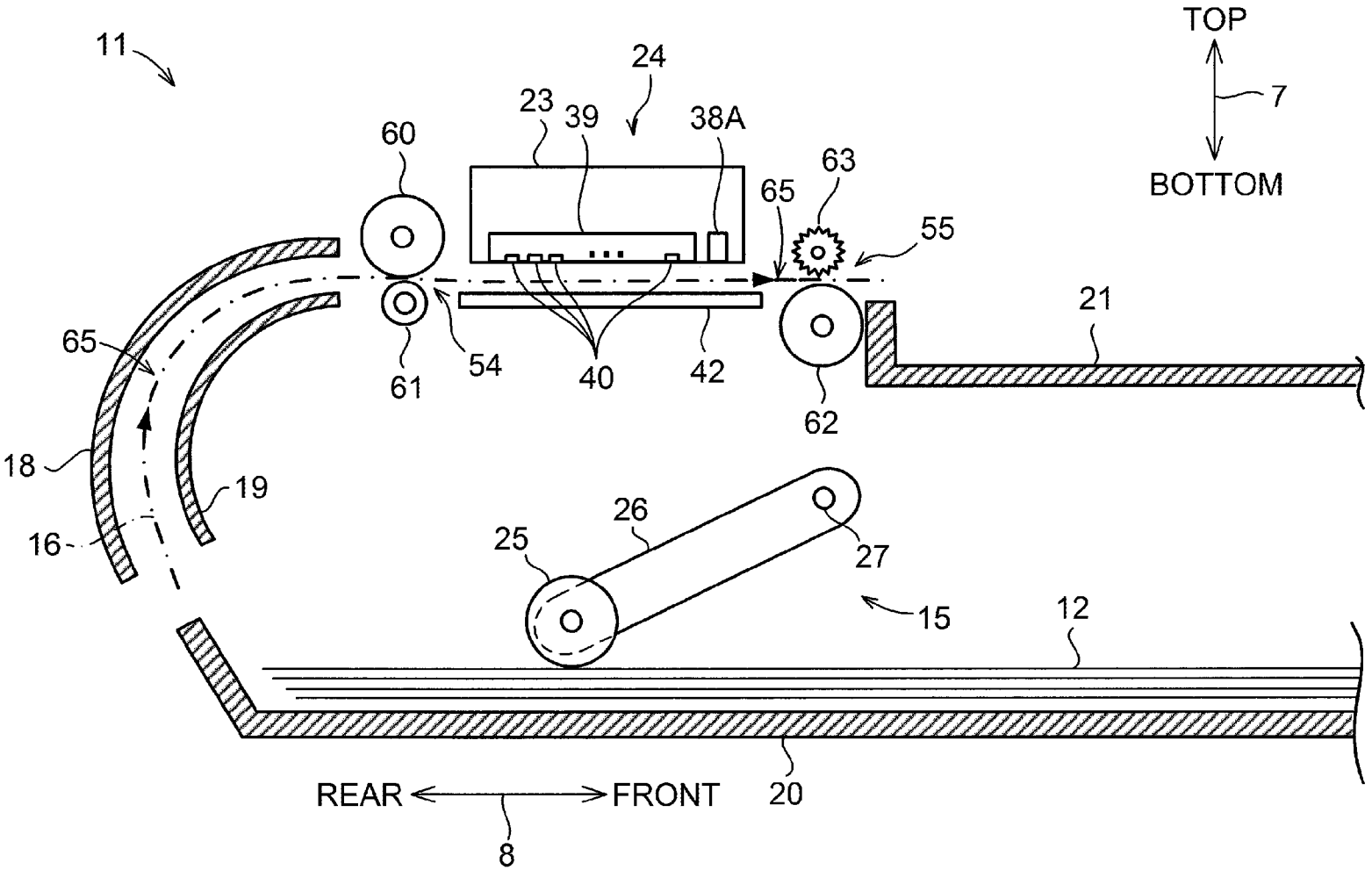
FIG. 2 is a vertical schematic sectional view depicting an internal structure of a printer unit of the multifunction device in the illustrative embodiment according to one or more aspects of the disclosure.

As depicted in FIG. 1, the multifunction device 10 (as an example of an inkjet recording apparatus) has a substantially rectangular parallelepiped shape. The multifunction device 10 includes a printer unit 11 at its lower portion. The printer unit 11 is configured to record one or more images onto one or more sheets 12 (see FIG. 2) using an inkjet recording method. The multifunction device 10 has various functions, e.g., a facsimile function and a printing function. As depicted in FIG. 2, the printer unit 11 includes a feed unit 15, a feed tray 20, a discharge tray 21, a conveyor roller pair 54, a recording unit 24, a discharge roller pair 55, and a platen 42. Components of the printer unit 11 are supported by a frame 68 depicted in FIG. 3B.

The feed tray 20 is configured to be inserted into and removed from the printer unit 11 in the front-rear direction 8 via the opening 13 (see FIG. 1) defined in the front of the printer unit 11. The feed unit 15 is configured to pick up a sheet 12 from the feed tray 20 to feed the sheet 12 into a conveyance path 65. The conveyor roller pair 54 is configured to convey, along a conveyance direction 16, the sheet 12 fed by the feed unit 15 into the conveyance path 65. The recording unit 24 is configured to record an image onto the sheet 12 conveyed by the conveyor roller pair 54. The discharge roller pair 55 is configured to discharge the sheet 12 having the image recorded thereon by the recording unit 24, onto the discharge tray 21. The discharge tray 21 is disposed above the feed tray 20. The platen 42 is disposed opposite to the recording unit 24 and is configured to support the sheet 12 thereon.

Feed Unit 15

As depicted in FIG. 2, the feed unit 15 is disposed above the feed tray 20 that is attached to the multifunction device 10 via the opening 13 of the printer unit 11. The feed unit 15 includes a feed roller 25, a feed arm 26, and a shaft 27. The feed roller 25 is rotatably supported at a distal end portion of the feed arm 26. The feed roller 25 is configured to convey the sheet 12 in the conveyance direction 16 by application of a driving force from a conveyor motor 102 (see FIG. 8). The feed arm 26 is pivotably supported by the shaft 27. The shaft 27 is supported by the frame 68 of the printer unit 11. The feed arm 26 is urged to pivot toward the feed tray 20 by its own weight and/or by an elastic force of, for example, a spring.

Conveyance Path 65

As depicted in FIG. 2, a portion of the conveyance path 65 is defined by an outer guide member 18 and an inner guide member 19 spaced apart from each other at a predetermined distance in the printer unit 11. The conveyance path 65 extends from a rear end of the feed tray 20. More specifically, the conveyance path 65 extends upwardly rearward from the rear end of the feed tray 20 and further extends curvedly toward the front to the discharge tray 21 via the recording unit 24. The sheet 12 fed by the feed unit 15 is conveyed to the discharge tray 21 while the sheet 12 is pinched by the conveyor roller pair 54, passes between the recording unit 24 and the platen 42, and is pinched by the discharge roller pair 55. The conveyance direction 16 of the sheet 12 in the conveyance path 65 is indicated by a dotted-and-dashed line in FIG. 2.

Conveyor Roller Pair 54 and Discharge Roller Pair 55

As depicted in FIG. 2, the conveyor roller pair 54 is disposed downstream of the feed unit 15 and upstream of the recording unit 24 in the conveyance path 65 with respect to the conveyance direction 16. The conveyor roller pair 54 includes a conveyor roller 60 and a pinch roller 61. The conveyor roller 60 is configured to be driven by the conveyor motor 102. The pinch roller 61 is configured to rotate following the rotation of the conveyor roller 60. The conveyor roller 60 and the pinch roller 61 pinch the sheet 12 therebetween and convey the sheet 12 along the conveyance direction 16. The discharge roller pair 55 is disposed downstream of the recording unit 24 in the conveyance path 65 with respect to the conveyance direction 16. The discharge roller pair 55 includes a discharge roller 62 and a spur 63. The discharge roller 62 is configured to be driven by the conveyor motor 102. The spur 63 is configured to rotate following the rotation of the discharge roller 62. The discharge roller 62 and the spur 63 pinch the sheet 12 therebetween and convey the sheet 12 along the conveyance direction 16.

Platen 42

Figure 3A:
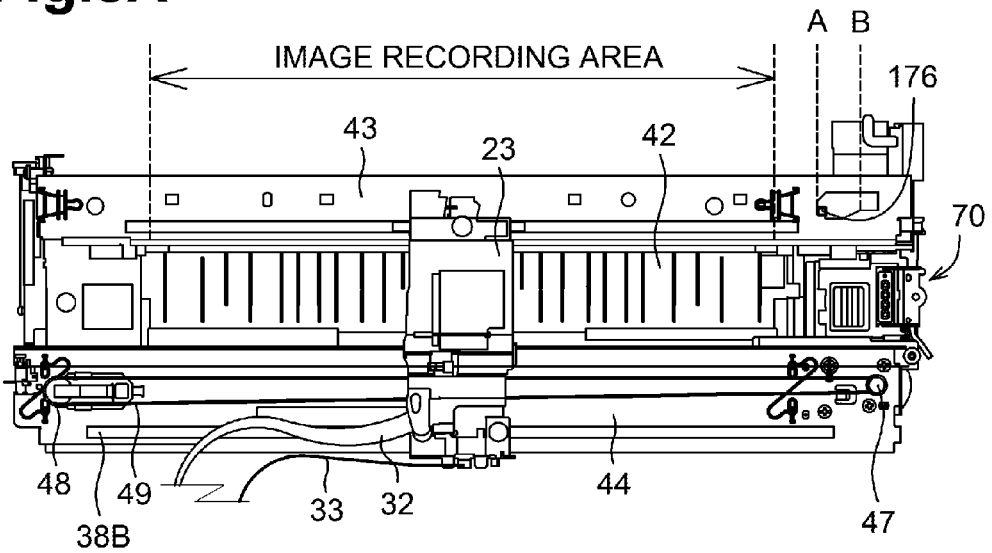
FIG. 3A is a plan view depicting a carriage and guide rails in the illustrative embodiment according to one or more aspects of the disclosure.

As depicted in FIGS. 2 and 3A, the platen 42 is disposed between the conveyor roller pair 54 and the discharge roller pair 55 in the conveyance direction 16. The platen 42 is disposed below the recording unit 24 and opposite to the recording unit 24 to define the conveyance path 65 therebetween. The platen 42 is configured to support from below the sheet 12 being conveyed in the conveyance path 65.

Recording Unit 24

Figure 3B:
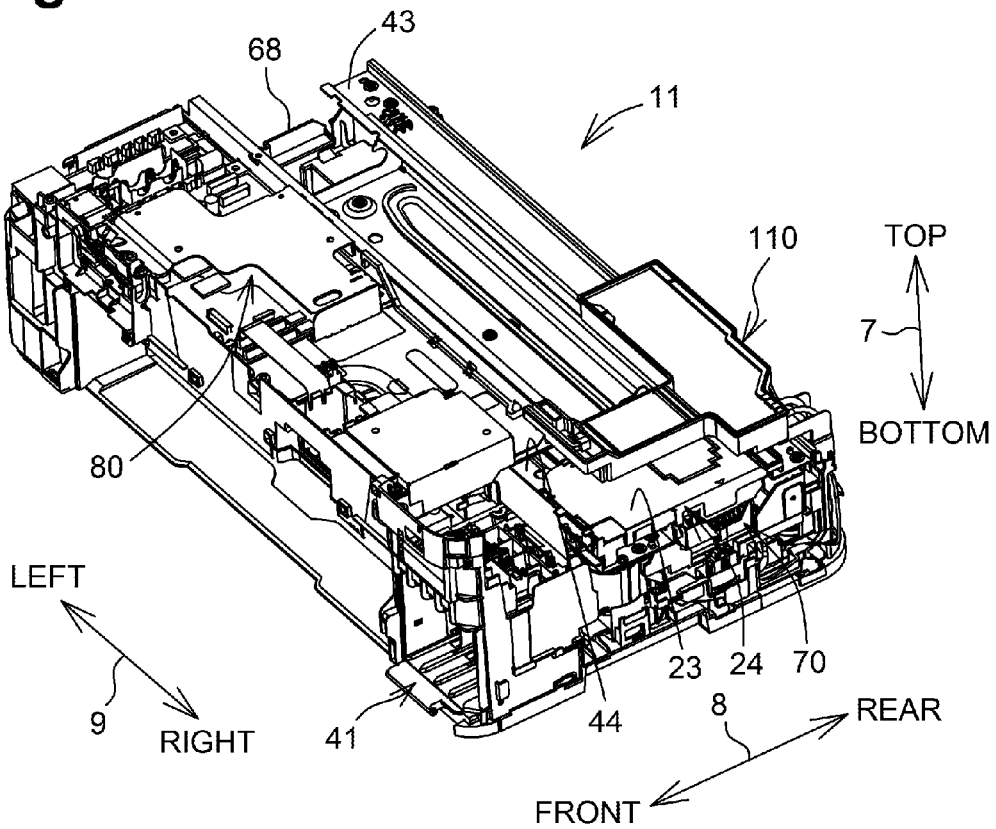
FIG. 3B is a perspective view depicting the printer unit in the illustrative embodiment according to one or more aspects of the disclosure.

As depicted in FIG. 2, the recording unit 24 is disposed between the conveyor roller pair 54 and the discharge roller pair 55 in the conveyance direction 16. The recording unit 24 includes a carriage 23, a recording head 39, and an encoder sensor 38A. As depicted in FIG. 3A, ink tubes 32 and a flexible flat cable 33 extend from the carriage 23. Ink cartridges (not depicted) attached to a cartridge mount 41 depicted in FIG. 3B are connected with the recording head 39 via the respective ink tubes 32. The ink tubes 32 are configured to supply ink stored in the respective ink cartridges to the recording head 39. The flexible flat cable 33 connects a circuit board 80 (see FIG. 3B) including a controller 130 (see FIG. 8) to the recording head 39. The flexible flat cable 33 is configured to transmit control signals from the controller 130 to the recording head 39.

As depicted in FIG. 3A, the carriage 23 is supported by guide rails 43 and 44. The guide rails 43 and 44 are spaced apart from each other in the front-rear direction 8 and extend respectively in the right-left direction 9. As depicted in FIG. 3B, the guide rails 43 and 44 are supported by the frame 68 of the printer unit 11. The carriage 23 is connected with a known belt mechanism disposed at the guide rail 44. The belt mechanism includes a drive pulley 47, a following pulley 48, and an endless belt 49. The drive pulley 47 is disposed at a right end portion of the guide rail 44 in the right-left direction 9. The following pulley 48 is disposed at a left end portion of the guide rail 44 in the right-left direction 9. The belt 49 is wound between the drive pulley 47 and the following pulley 48. The drive pulley 47 is configured to be driven by a carriage motor 103 (see FIG. 8). The belt 49 is connected with a bottom of the carriage 23.

The drive pulley 47 is rotated by the carriage motor 103 and the belt 49 is caused to rotate by the rotation of the drive pulley 47, whereby the carriage 23 reciprocates in the right-left direction 9 (as an example of a main scanning direction). More specifically, the carriage 23 moves in a forward direction, e.g., from the right to the left in the right-left direction 9, along the guide rails 43 and 44 when the carriage motor 103 rotates in one direction and applies a driving force to the carriage 23. The carriage 23 also moves in a reverse direction, e.g., from the left to the right in the right-left direction 9, along the guide rails 43 and 44 when the carriage motor 103 rotates in the other direction and applies a driving force to the carriage 23.

As depicted in FIG. 2, the recording head 39 is mounted on the carriage 23. The recording head 39 has a plurality of nozzles 40 in its bottom surface. The recording head 39 is supplied with ink from the respective ink cartridges via the respective ink tubes 32. The recording head 39 is configured to eject minuscule droplets of ink from appropriate ones of the nozzles 40. While the carriage 23 reciprocates, the recording head 39 ejects ink droplets onto the sheet 12 supported by the platen 42, thereby recording an image onto the sheet 12.

An encoder strip 38B is disposed on the guide rail 44. The encoder strip 38B extends in the right-left direction 9. The encoder sensor 38A is disposed on a bottom surface of the carriage 23. The encoder sensor 38A and the encoder strip 38B are disposed opposite to each other in the top-bottom direction 7. While the carriage 23 reciprocates, the encoder sensor 38A reads the encoder strip 38B to generate pulse signals and outputs the generated pulse signals to the controller 130. The encoder sensor 38A and the encoder strip 38B constitute a carriage sensor 38 depicted in FIG. 8.

Frame 68

As depicted in FIG. 3B, the cartridge mount 41 is disposed at the right front portion of the printer unit 11 (e.g., to the right of the opening 13). In the illustrative embodiment, a plurality of, for example, four, ink cartridges for ink of cyan, magenta, yellow, and black are allowed to be inserted into and removed from the cartridge mount 41. The respective colors of ink stored in the respective ink cartridges are supplied to the recording head 39 via respective ink needles (not depicted) and the respective ink tubes 32. The ink needles are disposed on a rear surface of the cartridge mount 41. The ink tubes 32 extend from the respective ink needles to the recording head 39.

The circuit board 80 is disposed above the front guide rail 44 and in front of an area in which the carriage 23 reciprocates. The circuit board 80 includes a known printed circuit board on which electronic components are placed. The controller 130 is configured to control operation of the multifunction device 10 and includes a microcomputer and various electronic components that are placed on the circuit board 80. A waste ink tank 110 is disposed above the rear guide rail 43 and a part of the reciprocation area of the carriage 23.

Maintenance Mechanism 70

Figure 4A:
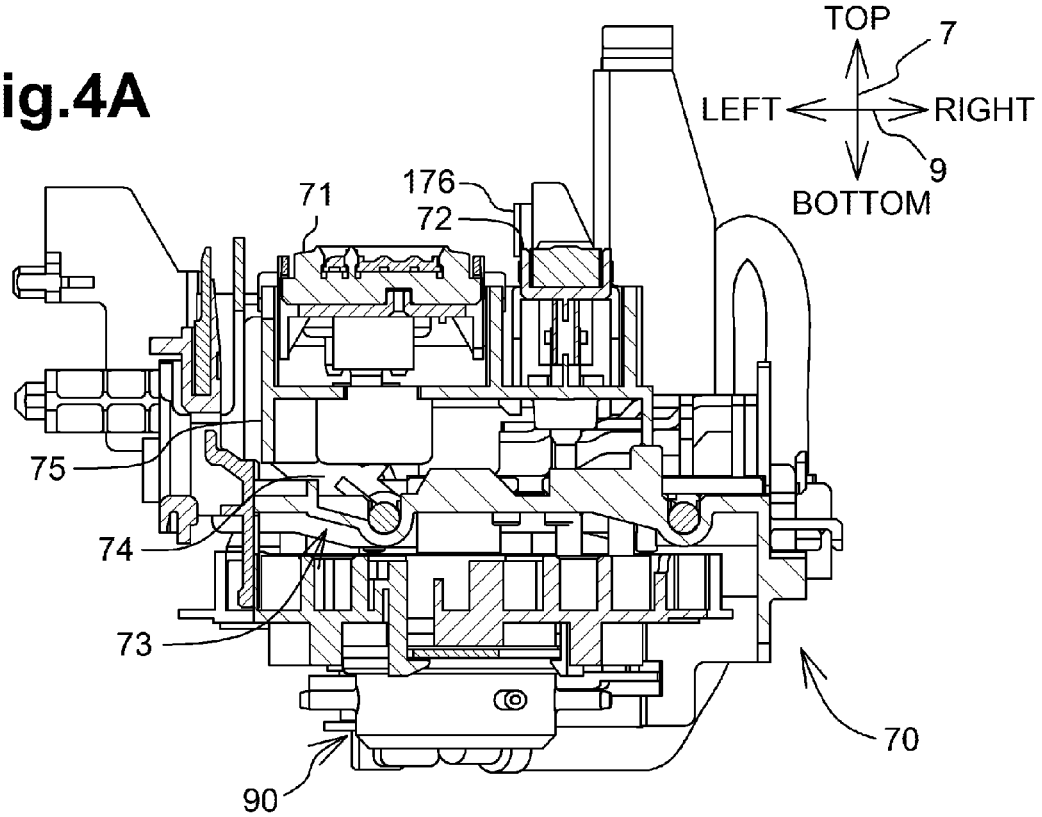
FIG. 4A is a sectional view depicting a maintenance mechanism, wherein the carriage is located at a position A in the illustrative embodiment according to one or more aspects of the disclosure.
Figure 4B:
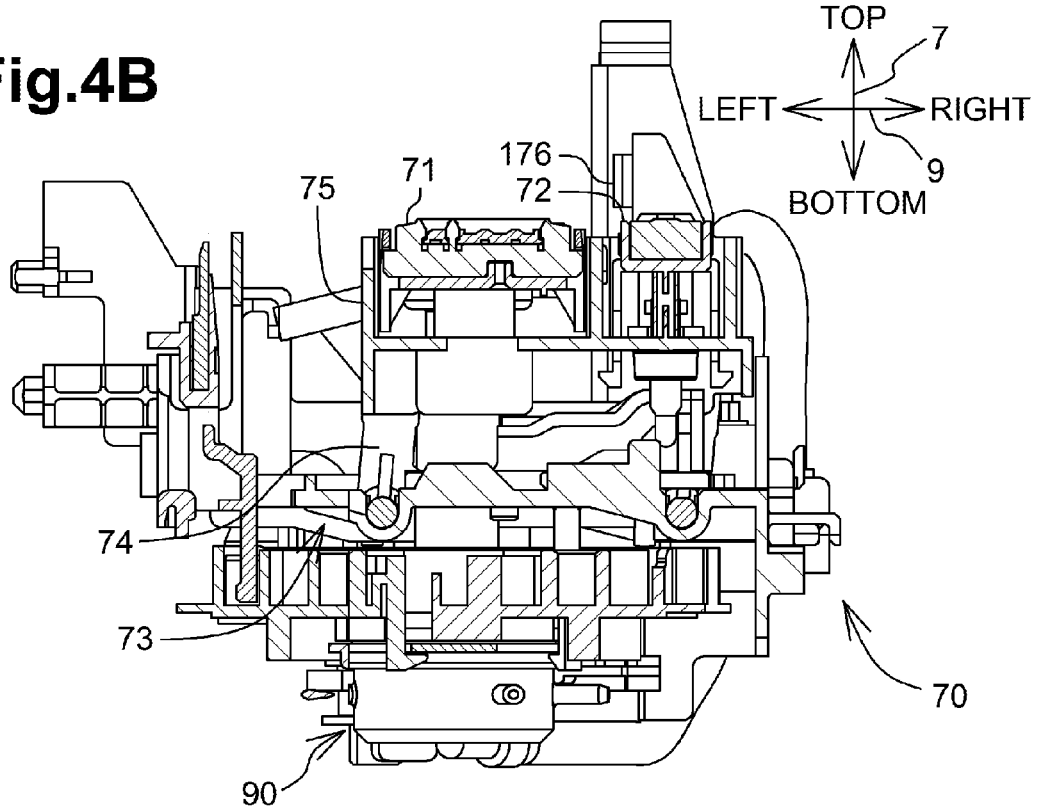
FIG. 4B is a sectional view depicting the maintenance mechanism, wherein the carriage is located in a position B in the illustrative embodiment according to one or more aspects of the disclosure.
Figure 5:
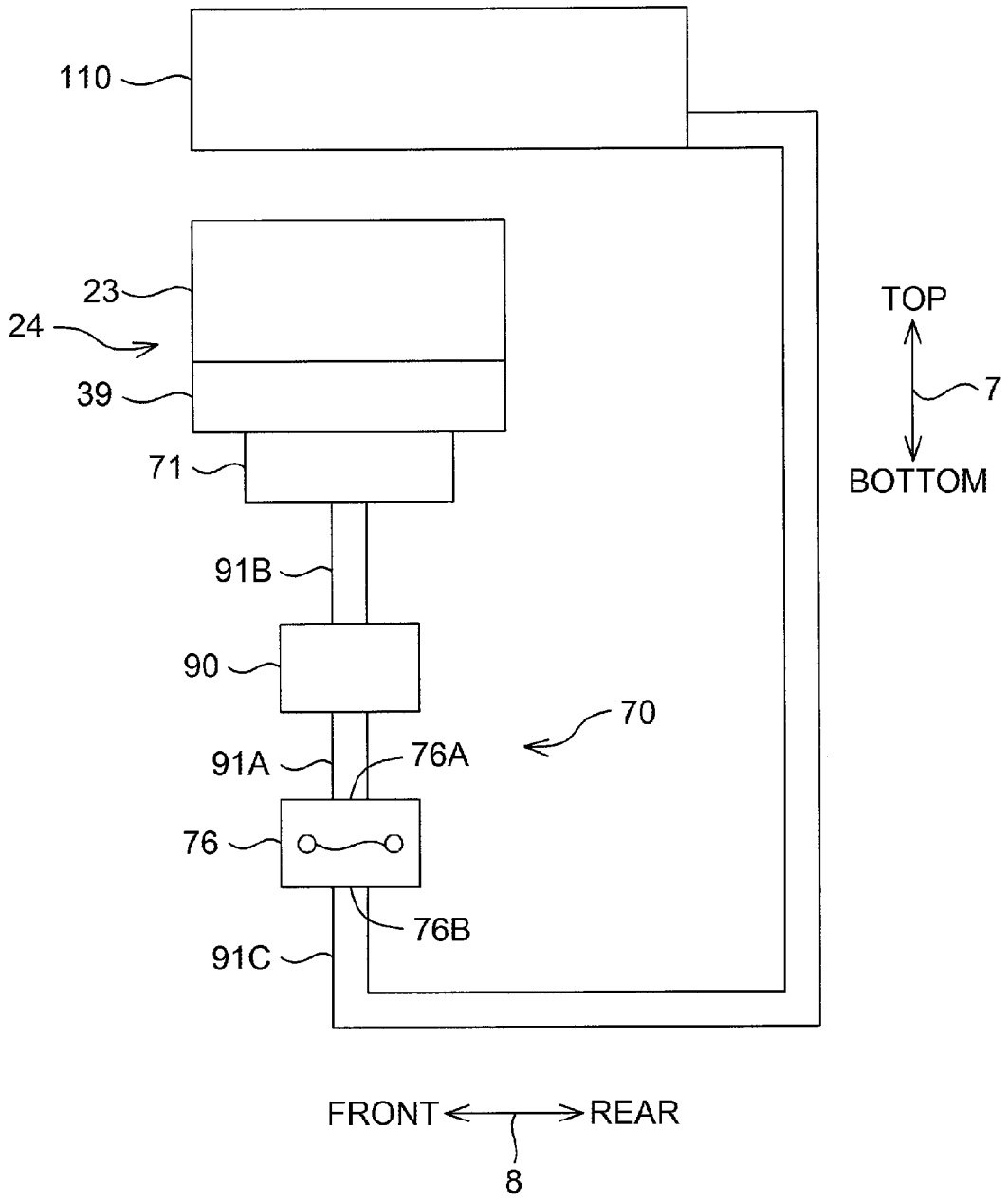
FIG. 5 is a schematic diagram depicting the maintenance mechanism in the illustrative embodiment according to one or more aspects of the disclosure.

A maintenance mechanism 70 depicted in FIGS. 4 and 5 is disposed at the printer unit 11. As depicted in FIG. 3A, the maintenance mechanism 70 is disposed to the right of the area in which the carriage 23 reciprocates during image recording (hereinafter, referred to as an "image recording area"). The image recording area is an area through which a sheet 12 may pass. That is, the maintenance mechanism 70 is disposed at a position where the maintenance mechanism 70 faces the carriage 23 when the carriage 23 is located in a maintenance area outside the image recording area.

The maintenance mechanism 70 is configured to perform purging for eliminating air bubbles or foreign objects together with ink by suction of ink from the nozzles 40 of the recording head 39. The maintenance mechanism 70 includes a cap 71, an exhaust cap 72, a lifting mechanism 73 (as an example of a link mechanism), a pump 76 (see FIGS. 5 and 8), a port switching mechanism 90 (as an example of a switching unit), and the waste ink tank 110 (as an example of a waste ink storage) (see FIG. 5). The cap 71 is configured to cover the surface of the recording head 39 in which the nozzles 40 are defined (hereinafter, referred to as a "nozzle surface"). The exhaust cap 72 is configured to cover exhaust holes defined in the recording head 39. The lifting mechanism 73 is configured to move the cap 71 closer to and away from the nozzle surface. The pump 76 is in communication with the cap 71 and is configured to suck ink. The waste ink tank 110 is configured to store ink therein that is sucked by suction by the pump 76 and flows into the waste ink tank 110.

The cap 71 is made of, for example, rubber. The cap 71 is disposed such that the cap 71 faces the carriage 23 when the carriage 23 is located in the maintenance area at the right end portion of the guide rails 43 and 44. The cap 71 comes into intimate contact with the nozzle surface by the lifting mechanism 73 to create an enclosed space between the nozzle surface and the cap 71. Inside of the cap 71 is divided into two spaces, that is, the cap 71 includes a black-ink cap portion and a color-ink cap portion. The black-ink cap portion is configured to cover a portion, in which nozzles 40 for ejecting black ink are defined, of the nozzle surface while creating an enclosed space between the portion of the nozzle surface and the black-ink cap portion. The color-ink cap portion is configured to cover another portion, in which nozzles 40 for ejecting color (cyan, magenta, and yellow) ink are defined, of the nozzle surface while creating an enclosed space between the portion of the nozzle surface and the color-ink cap portion. The black-ink cap portion is connected to a black ink port 95 and the color-ink cap portion is connected to a color ink port 96. The exhaust cap 72 is connected to an exhaust port 94.

The pump 76 is, for example, a rotary tube pump. As depicted in FIG. 5, the pump 76 has an inlet 76A and an outlet 76B. As the pump 76 is driven, a flow of fluid (e.g., ink or air) toward the outlet 76B from the inlet 76A is created. The port switching mechanism 90 is connected to an end of a tube 91A extending from the inlet 76A. The cap 71 is connected to an end of a tube 91B extending from the port switching mechanism 90. That is, the cap 71 and the inlet 76A are in communication with each other via the tubes 91A and 91B and the port switching mechanism 90. The waste ink tank 110 is detachably attached to an end of a tube 91C extending from the outlet 76B.

As depicted in FIG. 4, the lifting mechanism 73 includes a link 74. By rotation of the link 74 in synchronization with the movement of the carriage 23, a holder 75 moves between a position of FIG. 4A and a position of FIG. 4B. The holder 75 supports a contact lever 176 that protrudes upward in the vertical direction. The contact lever 176 extends to the reciprocation area of the carriage 23. The lifting mechanism 73 is configured to move the cap 71 in response to the pressing of the contact lever 176 by the carriage 23. More specifically, as the carriage 23 reaches a position A of FIG. 3A (as an example of a first position), the carriage 23 contacts the contact lever 176 located at a position of FIG. 4A. Under this situation, the cap 71 is distant from the nozzle surface. The position of the cap 71 depicted in FIG. 4A is defined as a separate position.

As the carriage 23 that is in contact with the contact lever 176 moves in the reverse direction from the position A of FIG. 3A, the lifting mechanism 73 moves the cap 71. When the carriage 23 is located in a position B (as an example of a second position), the lifting mechanism 73 makes the cap 71 come into contact with the nozzle surface. The position of the cap 71 depicted in FIG. 4B is defined as a covering position. By the driving of the pump 76 under this situation, the pressure in the enclosed space created between the cap 71 and the nozzle surface becomes lower than atmospheric pressure, whereby air bubbles or foreign objects are eliminated via the nozzles 40 together with ink through the suction. The sucked ink or foreign objects are sent to the waste ink tank 110 via the tubes 91A and 91B, 91C, the port switching mechanism 90, and the pump 76. As the carriage 23 moves in the forward direction from the position B, the lifting mechanism 73 separates the cap 71 from the nozzle surface. The positions A and B are outside the image recording area.

Port Switching Mechanism 90

The port switching mechanism 90 is configured to change the communication state between the cap 71 and the pump 76 and the communication state between the exhaust cap 72 and the pump 76. As depicted in FIG. 6, the port switching mechanism 90 includes a cylinder 99 having a bottom end and a cylindrical rotary body 92 that is disposed inside the cylinder 99. The cylinder 99 includes a plurality of ports (for example, six ports), a suction port 93, an exhaust port 94, the black ink port 95, the color ink port 96, and atmosphere ports 97 and 98.

The suction port 93 is disposed at a bottom wall of the cylinder 99. The other ports 94, 95, 96, 97, and 98 are disposed circumferentially at predetermined intervals in a side wall of the cylinder 99. The exhaust port 94 is in communication with the exhaust cap 72 via the tube 91B (see FIG. 5). The black ink port 95 is in communication with the internal space of the black-ink cap portion via the tube 91B. The color ink port 96 is in communication with the color-ink cap portion via the tube 91B. The atmosphere ports 97 and 98 are open to the atmosphere. One end of the tube 91A is connected to the suction port 93 and the other end of the tube 91A is connected to the inlet 76A of the pump 76.

Figure 6A:
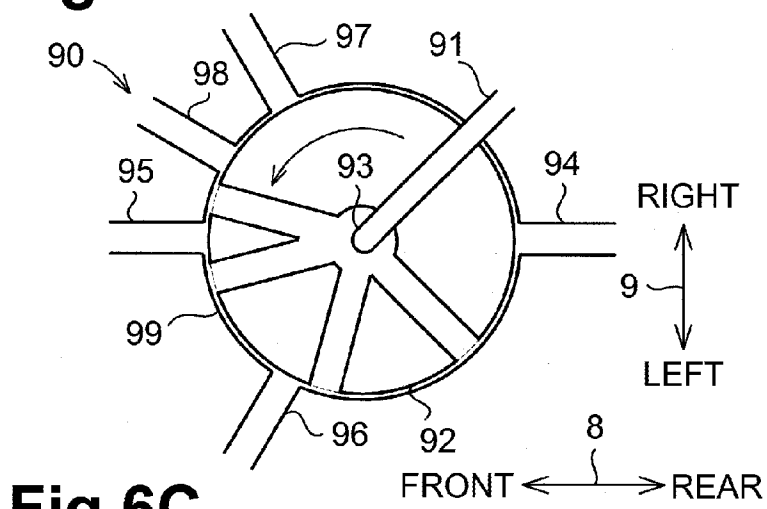
FIG. 6A is a bottom plan view depicting a port switching mechanism, in which a suction port is not in communication with any other ports in the illustrative embodiment according to one or more aspects of the disclosure.
Figure 6B:
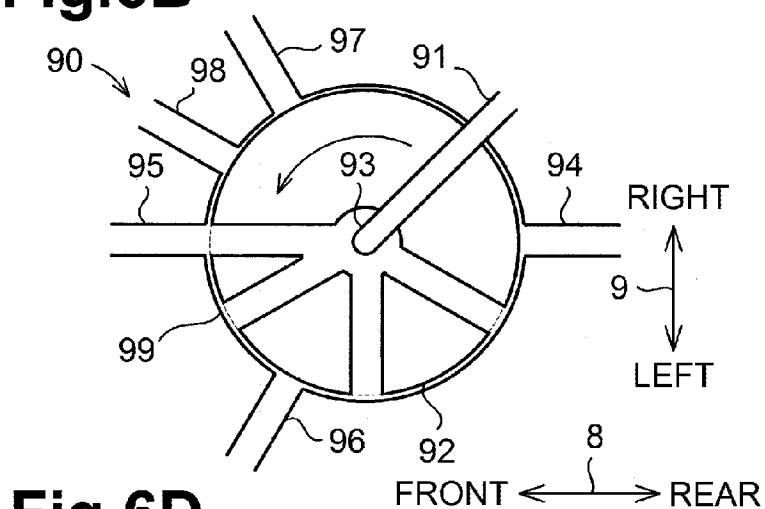
FIG. 6B is a bottom plan view depicting the port switching mechanism, in which the suction port is in communication with a black ink port in the illustrative embodiment according to one or more aspects of the disclosure.
Figure 6C:
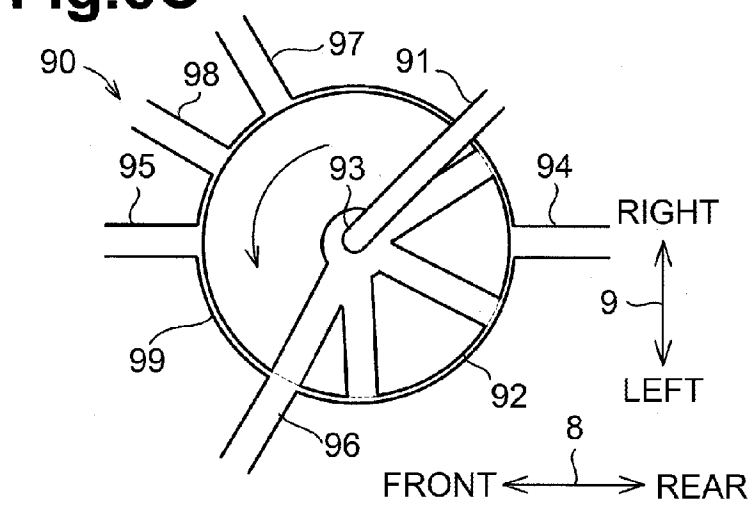
FIG. 6C is a bottom plan view depicting the port switching mechanism, in which the suction port is in communication with a color ink port in the illustrative embodiment according to one or more aspects of the disclosure.
Figure 6D:
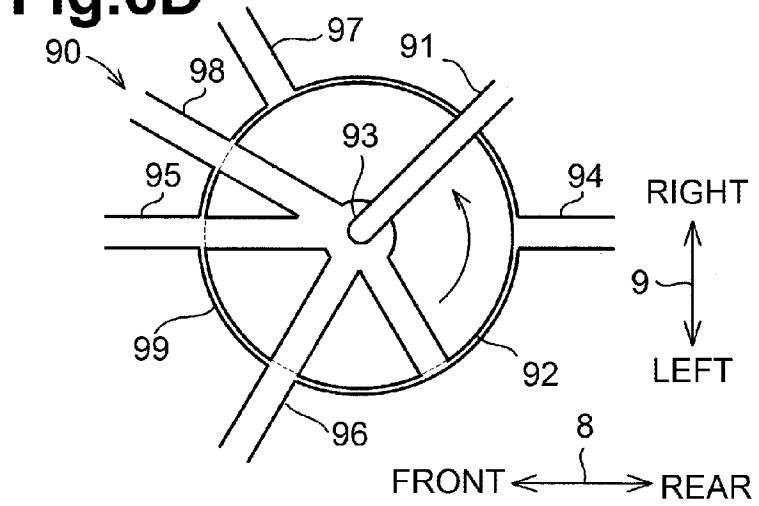
FIG. 6D is a bottom plan view depicting the port switching mechanism, wherein the suction port is in communication with the black ink port, the color ink port, and an atmosphere port in the illustrative embodiment according to one or more aspects of the disclosure.

The rotary body 92 rotates (e.g., counterclockwise in FIG. 6) in the cylinder 99 in accordance with the rotation of the conveyor motor 102. The communication states of the six ports 93, 94, 95, 96, 97, and 98 are changed in accordance with the rotation of the rotary body 92 in the cylinder 99. A phase of the rotary body 92 is detected by a sensor (not depicted). In FIG. 6A, the suction port 93 is not in communication with any other ports 94, 95, 96, 97 and 98. In FIG. 6B, the suction port 93 is in communication with the black ink port 95. In FIG. 6C, the suction port 93 is in communication with the color ink port 96. In FIG. 6D, the suction port 93 is in communication with the black ink port 95, the color ink port 96, and the atmosphere port 98.

As the rotary body 92 rotates to change its state from the state depicted in FIG. 6A to the state depicted in FIG. 6B, the black-ink cap portion of the cap 71 and the inlet 76A of the pump 76 come into communication with each other (as an example of a first state). By the driving of the pump 76 under this condition, the pressure in the internal space of the black-ink cap portion becomes lower than atmospheric pressure, whereby black ink and air existing in the nozzles 40 for black ink covered with the black-ink cap portion, or foreign objects adhering to the nozzle surface of the nozzles 40 for black ink are sucked toward the pump 76. As the rotary body 92 rotates to change its state from the state depicted in FIG. 6B to the state depicted in FIG. 6C, the color-ink cap portion of the cap 71 comes into communication with the inlet 76A of the pump 7 (as another example of the first state). By the driving of the pump 76 under this condition, the pressure in the internal space of the color-ink cap portion becomes lower than atmospheric pressure, whereby color ink and air existing in the nozzles 40 for color ink covered with the color-ink cap portion, or foreign objects adhering to the nozzle surface of the nozzles 40 for color ink are sucked toward the pump 76. The sucked black ink, color ink, air, and/or foreign objects are discharged to the waste ink tank 110 via the tubes 91A, 91B and 91C, the port switching mechanism 90, and the pump 76.

As the rotary body 92 rotates to change its state from the state depicted in FIG. 6C to the state depicted in FIG. 6D, the suction port 93 comes into communication with the atmosphere port 98. Thus, the pump 76 becomes open to the atmosphere (as an example of a second state). The black ink port 95 and the color ink port 96 are in communication with the atmosphere port 98 via the suction port 93. Thus, the pressure in the internal space of the black-ink cap portion and the pressure in the internal space of the color-ink cap portion become the same as atmospheric pressure. If the carriage 23 is moved in the forward direction from the position B while the pressure in the internal space of the cap 71 is lower than atmospheric pressure, in some cases, the cap 71 might not separate from the recording head 39. To prevent such a situation from occurring, the pressure in the internal space of the cap 71 is made become the same as atmospheric pressure before the carriage 23 is moved from the position B. In other embodiments, for example, the suction port 93, the black ink port 95, and the color ink port 96 may be made in communication with the atmosphere port 97 instead of the atmosphere port 98. Hereinafter, an explanation will be made on a case where the suction port 93, the black ink port 95, and the color ink port 96 are made in communication with the atmosphere port 98.

Waste Ink Tank 110

Figure 7:
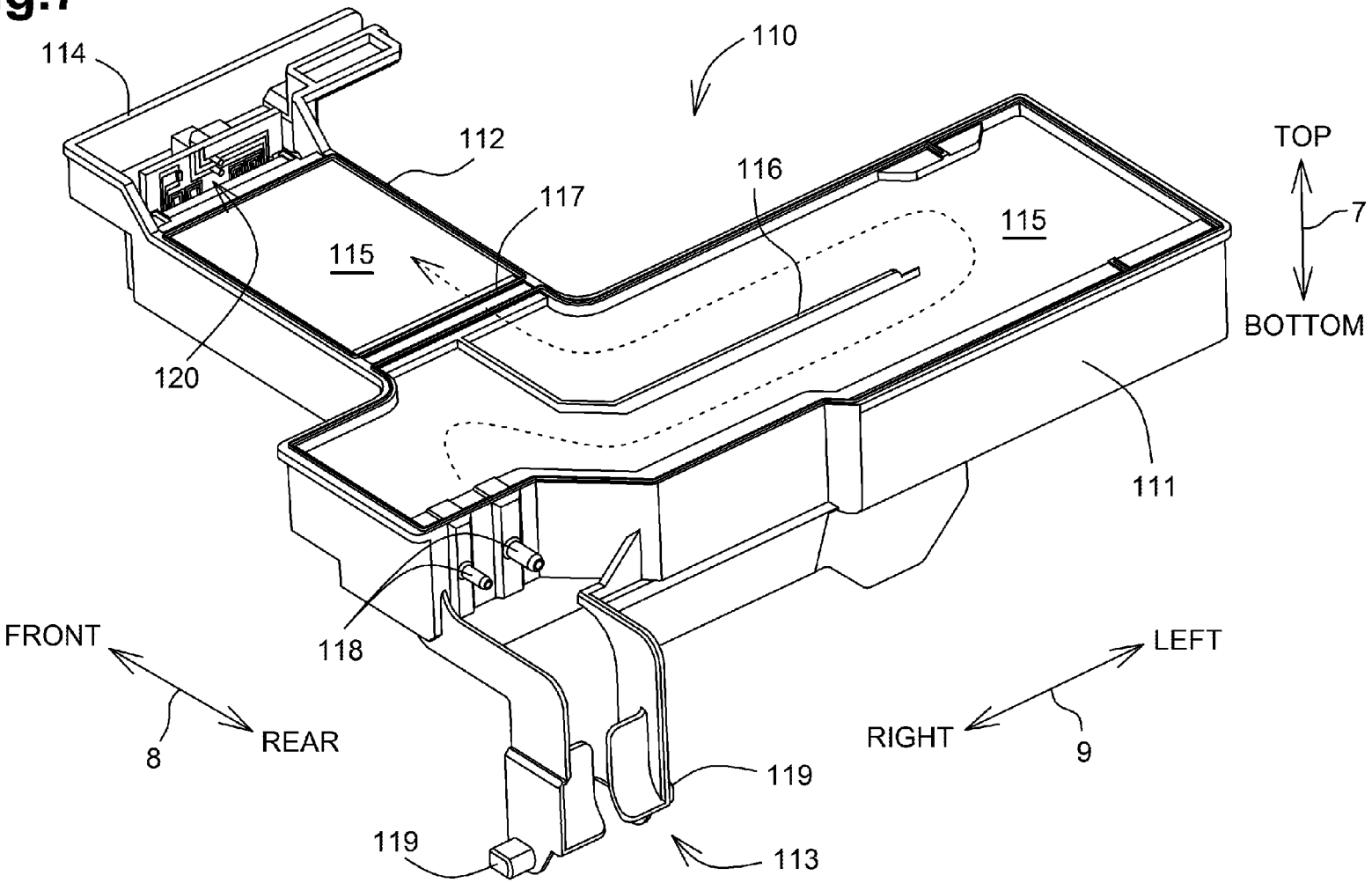
FIG. 7 is a perspective view depicting a waste ink tank in the illustrative embodiment according to one or more aspects of the disclosure.

The waste ink tank 110 is configured to store therein ink discharged from the nozzles 40 via the pump 76. As depicted in FIG. 7, the waste ink tank 110 has a substantially T-shaped box shape in plan view. The waste ink tank 110 includes an ink absorber 115 therein. The shape and placement of the waste ink tank 110 are not limited to the above example. In other embodiments, for example, the waste ink tank 110 may have any shape that is capable of holding the ink absorber 115 therein and the waste ink tank 110 may be disposed at any position inside of the multifunction device 10.

The waste ink tank 110 includes a first body portion 111, a second body portion 112, a third body portion 113, and a fourth body portion 114. The first body portion 111 extends along the right-left direction 9 to constitute a horizontal line of the letter "T". The second body portion 112 extends along the front-rear direction 8 from a substantially central portion of the first body portion 111 in the right-left direction 9 to constitute a vertical line of the letter "T". The third body portion 113 and the second body portion 112 are disposed on opposite sides of the first body portion 111 (e.g., the third body portion 113 is disposed at the rearward portion of the waste ink tank 110), and the third body portion 113 is adjacent to the first body portion 111. The fourth body portion 114 and the first body portion 111 are disposed on opposite sides of the second body portion 112 (e.g., the fourth body portion 114 is disposed at the forward portion of the waste ink tank 110), and the fourth body portion 114 is adjacent to the second body portion 112.

The first body portion 111 and the second body portion 112 each have a box-like shape with its top open. The first body portion 111 and the second body portion 112 accommodate the ink absorber 115 in their internal spaces. That is, the ink absorbers 115 positioned in the waste ink tank 110 are partially exposed (e.g., their upper surfaces are exposed). The ink absorbers 115 are made of porous member, for example, polyurethane foam. Ink enters holes formed in the porous member and thus is absorbed in each of the ink absorbers 115.

A bent plate 116 stands on a bottom surface of the first body portion 111. The bent plate 116 extends rearward from a vicinity of a boundary between the first body portion 111 and the second body portion 112 and is bent toward the left at a substantially middle position of the first body portion 111 in the front-rear direction 8. A bridge plate 117 stands at the vicinity of the boundary between the first body portion 111 and the second body portion 112 and extends from an end of the bent plate 116 in the right-left direction 9. The bridge plate 117 allows ink flowing into the first body portion 111 to further flow into the second body portion 112 through its left portion with respect to a coupling portion of the bent plate 116 and the bridge plate 117. In contrast to this, the bridge plate 117 does not allow ink flowing into the first body portion 111 to further flow into the second body portion 112 through its right portion with respect to the coupling portion of the bent plate 116 and the bridge plate 117. The first body portion 111 includes a connector 118 at its outer rear surface. The tube 91C (see FIG. 5) is detachably connected to the connector 118. That is, ink that flows into the waste ink tank 110 from the tube 91C via the connector 118 is absorbed by the ink absorbers 115, diffuses along a flow path indicated by a dashed line with an arrow in FIG. 7, and thus reach a rear end portion of the second body portion 112.

The third body portion 113 extends downward from a right end portion of the rear surface of the first body portion 111. The third body portion 113 includes a pair of protrusions 119 that protrude from one end portion (e.g., a lower end portion) along the right-left direction 9. The protrusions 119 are configured to be inserted into holes (not depicted), respectively, defined in the frame 68 of the printer unit 11. With the engagement of the protrusions 119 and the holes, the waste ink tank 110 is supported such that the waste ink tank 110 can pivot on an axis passing through the protrusions 119 (e.g., axis extending along the right-left direction 9) with respect to the frame 68.

The fourth body portion 114 is disposed at a front surface of the second body portion 112. A detection electrode 120 is disposed on a boundary between the fourth body portion 114 and the second body portion 112. The detection electrode 120 includes a detection surface that faces the second body portion 112 and a rear surface that is opposite to the detection surface and faces the fourth body portion 114. A wire (not depicted) extends toward the circuit board 80 from the rear surface opposite to the detection surface of the detection electrode 120. The wire connects the controller 130, which is placed on the circuit board 80, and the detection electrode 120 electrically.

When ink has reached the detection electrode 120, that is, an amount of ink stored in the waste ink tank 110 exceeds a predetermined threshold ink amount (hereinafter, such a state is referred to as a "nearly-full state"), the detection electrode 120 outputs a high level signal to the controller 130. When ink has not reached the detection electrode 120, i.e., the amount of ink stored in the waste ink tank 110 is less than or equal to the threshold ink amount, the detection electrode 120 outputs a low level signal to the controller 130. It is desirable that the detection electrode 120 be disposed such that the detection electrode 120 outputs a high level signal in a state where the waste ink tank 110 still has room for storing some more amount of ink. That is, it is desirable that the inkjet printer 1 have a configuration in which purging is allowed to be performed a predetermined number of times (e.g., twice) even after the detection electrode 120 output a high level signal.

Driving Force Transmission Mechanism 104

Figure 8:
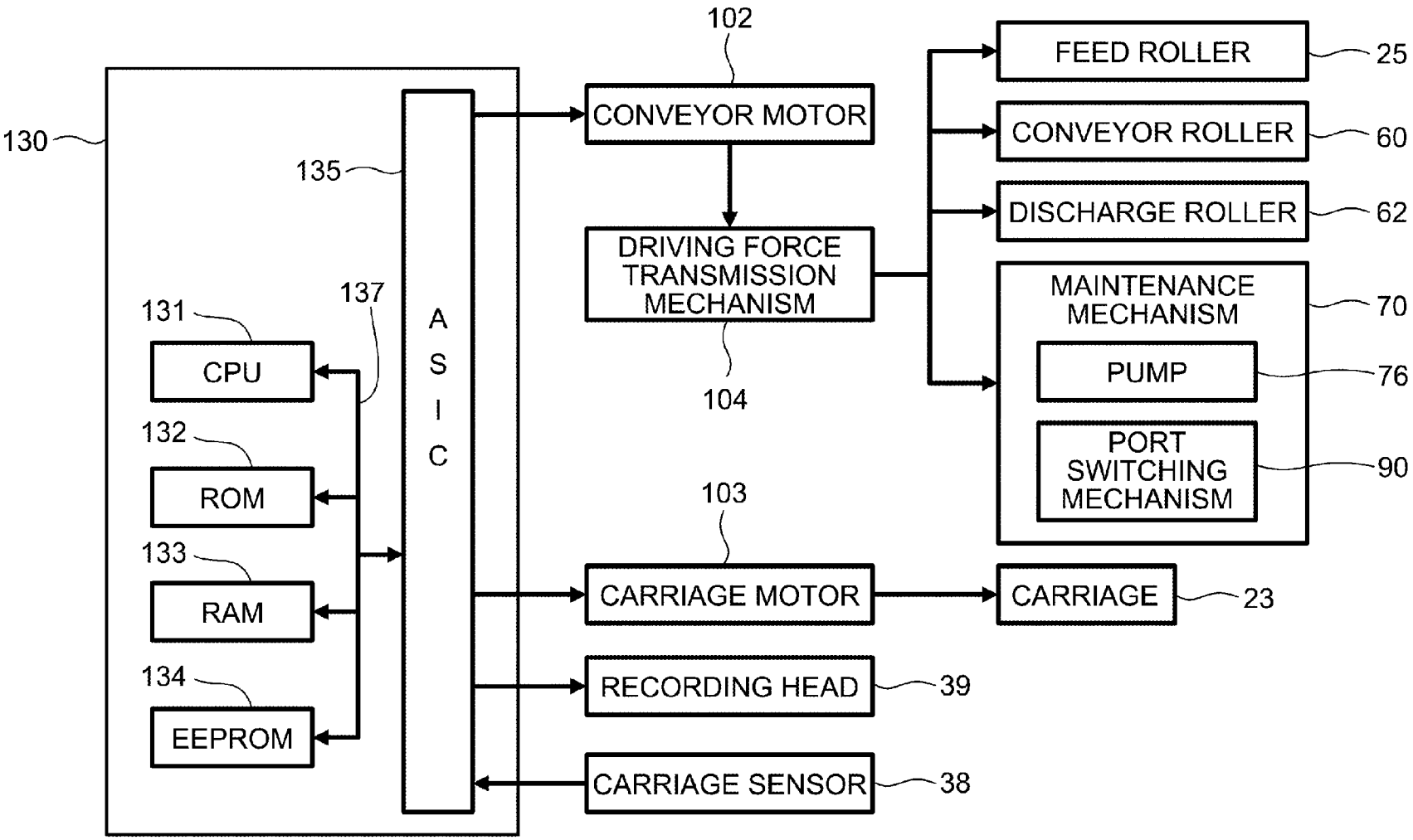
FIG. 8 is a block diagram depicting the printer unit in the illustrative embodiment according to one or more aspects of the disclosure.

A driving force transmission mechanism 104 depicted in FIG. 8 is configured to transmit a driving force from the conveyor motor 102 to the feed roller 25, the conveyor roller 60, the discharge roller 62, and the maintenance mechanism 70. The driving force transmission mechanism 104 includes a combination of some or all of gears, pulleys, an annular belt, a planet gear mechanism (e.g., a pendulum gear mechanism), and a one-way clutch. A destination to which a driving force of the conveyor motor 102 is to be transmitted is changed by the carriage 23.

More specifically, when the carriage 23 is located at a position more left than the position A of FIG. 3, the driving force transmission mechanism 104 transmits a driving force of the conveyor motor 102 to the feed roller 25, the conveyor roller 60, and the discharge roller 62 but not transmit to the maintenance mechanism 70. When the carriage 23 is located at a position more right than the position A of FIG. 3 (i.e., when the contact lever 176 has been moved to the right), the driving force transmission mechanism 104 transmits a driving force of the conveyor motor 102 to the conveyor roller 60, the discharge roller 62, and the maintenance mechanism 70 but not transmit to the feed roller 25. In this state, the driving force transmission mechanism 104 drives the pump 76 by the rotation of the conveyor motor 102 in one direction, and drives the port switching mechanism 90 by the rotation of the conveyor motor 102 in the other direction.

Controller 130

As depicted in FIG. 8, the controller 130 includes a central processing unit ("CPU") 131, a read-only memory ("ROM") 132, a random-access memory ("RAM") 133, an electrically erasable programmable read only memory ("EEPROM") 134, and an application-specific integrated circuit ("ASIC") 135 that are connected with each other via an internal bus 137. The ROM 132 stores programs for the CPU 131 to control various operations. The RAM 133 is employed as a storage area for temporarily storing data or signals to be used for the CPU 131 to execute the programs, or as a workspace for data processing by the CPU 131. The EEPROM 134 is configured to store settings and flags that need to be held after the multifunction device 10 is powered off.

The ASIC 135 is connected with the conveyor motor 102 and the carriage motor 103. The ASIC 135 receives a drive signal for rotating a predetermined motor from the CPU 131 to output a drive current responsive to the drive signal to the predetermined motor. The predetermined motor thus rotates by the application of the drive current from the ASIC 135. For example, the controller 130 drives the rollers or the maintenance mechanism 70 by controlling the driving of the conveyor motor 102. The controller 130 reciprocates the carriage 23 by controlling the driving of the carriage motor 103. The controller 130 controls the recording head 39 to eject ink from appropriate one or more of the nozzles 40. A carriage sensor 38 is connected to the ASIC 135. The controller 130 detects the position of the carriage 23 based on pulse signals outputted from the carriage sensor 38.

Processing for Purging and Processing Prior to Replacement of Waste Ink Tank 110

Figure 9:
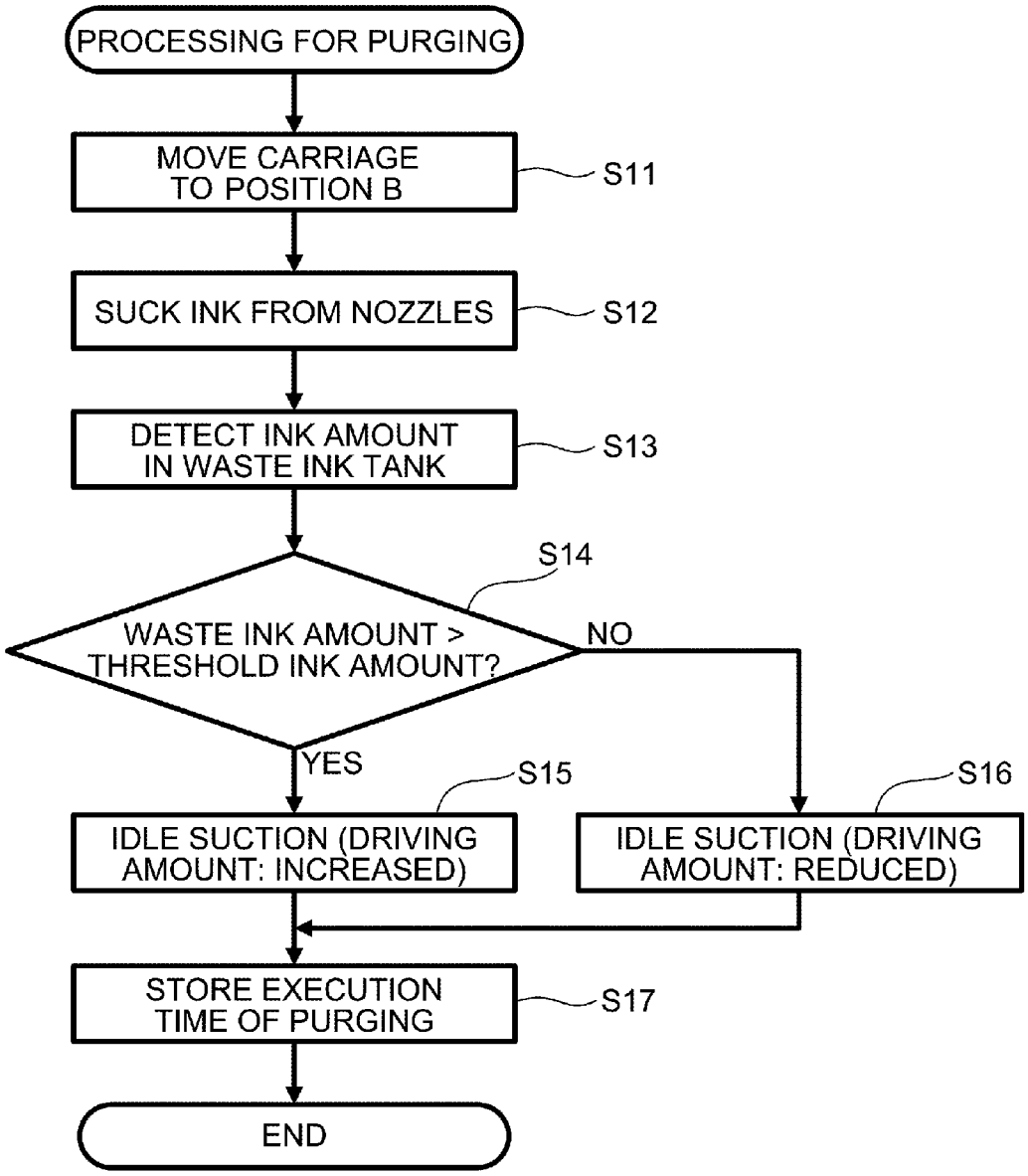
FIG. 9 is a flowchart depicting processing for purging in the illustrative embodiment according to one or more aspects of the disclosure.
Figure 10:
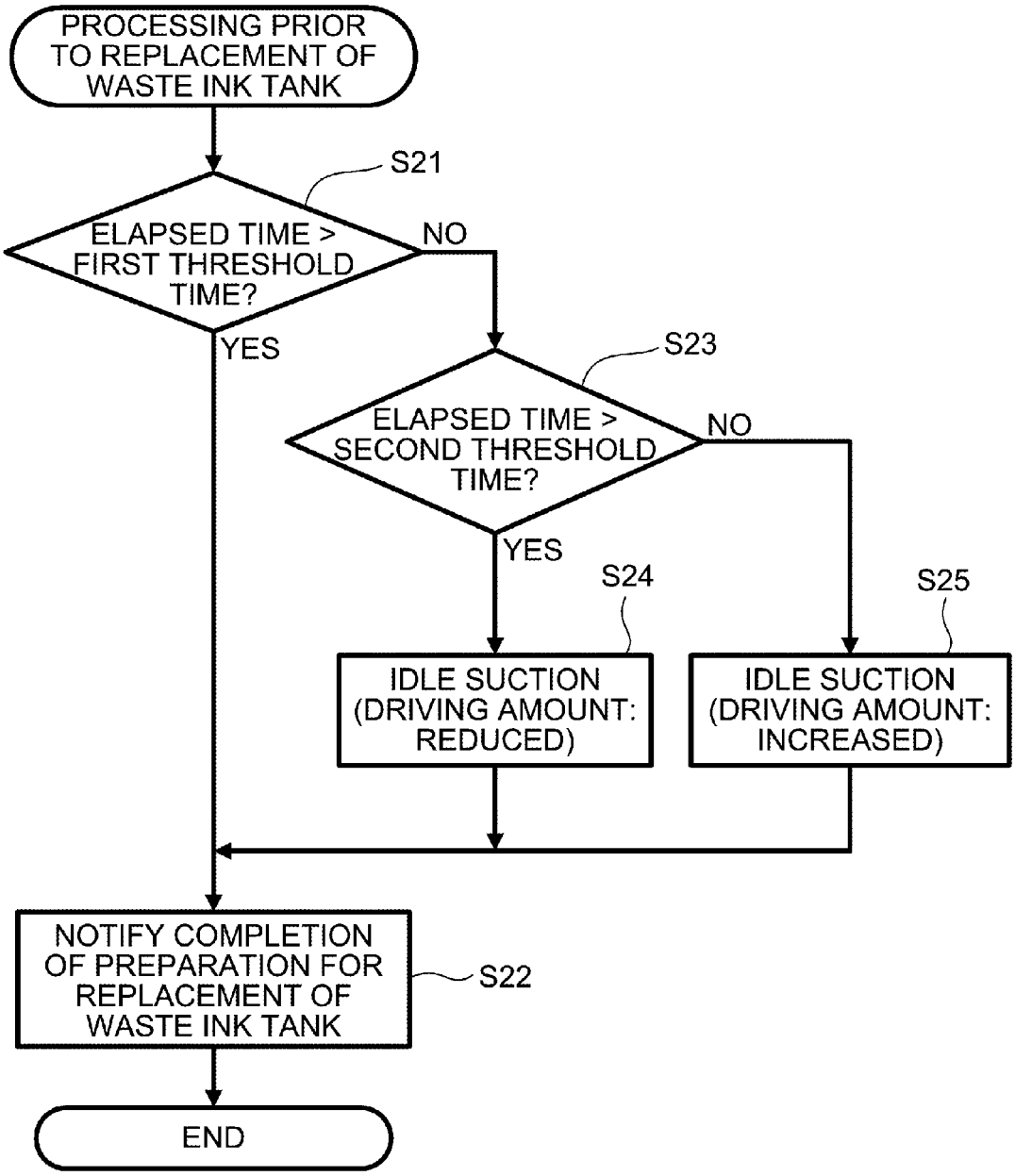
FIG. 10 is a flowchart depicting processing prior to replacement of the waste ink tank in the illustrative embodiment according to one or more aspects of the disclosure.

Referring to FIGS. 9 and 10, processing for purging and processing prior to replacement of the waste ink tank 110, which are performed in the multifunction device 10, will be described below. These processing are executed by the CPU 131 of the controller 130. Each processing described below may be executed by the CPU 131 that reads the program stored in the ROM 132 or may be executed by a hardware circuit installed on the controller 130.

Processing for purging depicted in FIG. 9 is processing for discharging ink forcefully from the nozzles 40 of the recording head 39. The processing for purging is executed, for example, in an interval between recording an image onto a sheet 12 by the printer unit 11 (hereinafter, referred to as "image recording") and subsequent image recording. The controller 130 may execute processing for purging, for example, on condition that a predetermined time period has elapsed since the most recent purging was ended and image recording is not currently being performed.

The controller 130 drives the carriage motor 103 such that the carriage 23 moves to the position B (e.g., step S11). In response to this, the lifting mechanism 73 moves the cap 71 to the covering position and a driving force of the conveyor motor 102 is transmitted to the maintenance mechanism 70 via the driving force transmission mechanism 104.

Subsequent to this, the controller 130 drives the pump 76 to suck ink from the nozzles 40 of the recording head 39 (e.g., step S12). More specifically, the controller 130 executes ink suction from the nozzles 40 for black ink and ink suction from the nozzles 40 for color ink separately. The ink suction in step S12 is an example of purging. In other embodiments, for example, the controller 130 may execute idle suction in an interval between the ink suction from the nozzles 40 for black ink and the ink suction from the nozzles 40 for color ink.

More specifically, the controller 130 rotates the conveyor motor 102 in the other direction to switch the port switching mechanism 90 to the state of FIG. 6B. Thus, the black-ink cap portion of the cap 71 and the inlet 76A of the pump 76 come into communication with each other via the tubes 91A and 91B and the port switching mechanism 90. Then, the controller 130 rotates the conveyor motor 102 in the one direction to drive the pump 76, whereby black ink discharged from the nozzles 40 for black ink is discharged to the waste ink tank 110 via the cap 71, the tubes 91A, 91B, and 91C, the port switching mechanism 90, and the pump 76.

The controller 130 rotates the conveyor motor 102 in the other direction to switch the port switching mechanism 90 to the state of FIG. 6C. Thus, the color-ink cap portion of the cap 71 and the inlet 76A of the pump 76 come into communication with each other via the tubes 91A and 91B and the port switching mechanism 90. Then, the controller 130 rotates the conveyor motor 102 in the one direction to drive the pump 76, whereby color ink discharged from the nozzles 40 for color ink is discharged to the waste ink tank 110 via the cap 71, the tubes 91A, 91B, and 91C, the port switching mechanism 90, and the pump 76.

Then, the controller 130 detects an amount of ink stored in the waste ink tank 110 (hereinafter, referred to as a "waste ink amount") (e.g., step S13). More specifically, when a high level signal is outputted from the detection electrode 120, i.e., when the waste ink amount exceeds a threshold ink amount (hereinafter, this situation is referred to as a "nearly-full state") (e.g., Yes in step S14), the controller 130 executes idle suction in one manner (e.g., step S15). When a low level signal is outputted from the detection electrode 120, i.e., when the waste ink amount is lower than or equal to the threshold ink amount (e.g., No in step S14), the controller 130 executes idle suction in another manner (e.g., step S16). The timing for detecting the waste ink amount is not limited to after the ink suction (e.g., step S12) is executed as described above. In other embodiments, for example, the detection of the waste ink amount may be executed any time before idle suction (e.g., step S15 or S16) is executed. The idle suction in step S15 or S16 is an example of second idle suction.

Then, the controller 130 executes idle suction in which ink remaining in the tube 91C extending from the outlet 76B of the pump 76 is discharged to the waste ink tank 110 (e.g., step S15 or S16). More specifically, the controller 130 rotates the conveyor motor 102 in the other direction to switch the port switching mechanism 90 to the state of FIG. 6D. Thus, the inlet 76A of the pump 76 becomes open to the atmosphere via the port switching mechanism 90 and the tube 91A, and the pressure in the internal space of the black-ink cap portion and the pressure in the internal space of the color-ink cap portion of the cap 71 become the atmosphere pressure. Then, the controller 130 rotates the conveyor motor 102 in the one direction to drive the pump 76. Thus, ink remaining in the tube 91C flows into the waste ink tank 110 due to air flow from the atmosphere port 98.

The controller 130 changes a driving amount of the pump 76 in the idle suction appropriately in accordance with the waste ink amount detected in step S13. More specifically, when the waste ink tank 110 is in the nearly-full state (e.g., Yes in step S14), the controller 130 relatively increases the driving amount of the pump 76 (e.g., a driving period of the pump 76) in the idle suction (e.g., step S15). When the waste ink amount is less than or equal to the threshold ink amount (e.g., No in step S14), the controller 130 relatively reduces the driving amount of the pump 76 in the idle suction (e.g., step S16). That is, the controller 130 increases the driving amount of the pump 76 in the idle suction (e.g., step S15) when the waste ink tank 110 is in the nearly-full state as compared to the driving amount of the pump 76 in the idle suction (e.g., step S16) when the waste ink tank 110 have not yet become the nearly-full state.

Then, the controller 130 stores, in the EEPROM 134, the execution time at which the ink suction (e.g., step S12) has been executed (e.g., step S17) and ends the purging processing. The execution time is overwritten every time ink suction (e.g., step S12) is executed. That is, the EEPROM 134 stores the execution time of the most recent purging.

The controller 130 calculates the amount of ink discharged in ink suction (e.g., step S12) that is executed after the waste ink tank 110 becomes in the nearly-full state. For example, the controller 130 sets a count flag "ON" on condition that the "waste ink amount" exceeds the threshold ink amount for the first time (e.g., Yes in step S14). On condition that the count flag indicates "ON", the controller 130 adds up the amount of ink discharged in the ink suction (e.g., step S12) and stores the discharged ink amount in the EEPROM 134. For example, the amount of discharged ink may be estimated by calculating the driving amount (e.g., the rotating amount) of the pump 76 during the ink suction (e.g., step S12). In other embodiments, for example, the amount of ink discharged in a single step of ink suction (e.g., step S12) may be prestored in the ROM 132 or the EEPROM 134 as a fixed amount and the fixed amount may be added every time a step of ink suction (e.g., step S12) is executed.

When the calculated ink amount exceeds the threshold value (hereinafter, this situation is referred to as a "full state"), the controller 130 notifies a user that the waste ink tank 110 needs to be replaced with a new one. The notification manner is not limited to a specific manner. For example, the controller 130 may display a message on a display of the multifunction device 10, may turn on an LED and remain it on (or flash it), or may output a voice message or sound. In the illustrative embodiment, the multifunction device 10 requires the user to perform a predetermined operation indicating that the waste ink tank 110 is to be replaced with a new one before the user actually replaces the waste ink tank 110.

The user's predetermined operation may be, for example, an input by pressing a button disposed on the multifunction device 10 or an input through an external device connected to the multifunction device 10 via a communication network. As the user performs the predetermined operation, the controller 130 receives an input indicating that the waste ink tank 110 is to be replaced with a new one (hereinafter, referred to as an "input for waste ink tank replacement").

On condition that the input for waste ink tank replacement is received, processing prior to replacement of the waste ink tank 110 depicted in FIG. 10 is started. When an elapsed time exceeds a first threshold time (e.g., Yes in step S21), the controller 130 notifies the user that preparation for replacement of the waste ink tank 110 is completed (e.g., step S22) and ends the processing prior to replacement of the waste ink tank 110. This notification is an example of notification to the user of permission to replace the waste ink tank 110. The notification manner is not limited to a specific manner either, as in the above-described case of notifying the "full state". The elapsed time refers to a time that has elapsed from the execution of the most recent purging to the reception of the input for waste ink tank replacement. The elapsed time is calculated by subtracting the execution time of the most recent purging stored in the EEPROM 134 from the time at which the input for waste ink tank replacement is received.

When the elapsed time is shorter than or equal to the first threshold time (e.g., No in step S21), the controller 130 executes idle suction as described below. When the elapsed time exceeds a second threshold time, the controller 130 executes idle suction in which the driving amount (e.g., the driving time) of the pump 76 is relatively reduced (e.g., step S24). The second threshold time is shorter than the first threshold time. When the elapsed time is shorter than or equal to a second threshold time (e.g., No in step S23), the controller 130 executes idle suction in which the driving amount of the pump 76 is relatively increased (e.g., step S25). That is, the controller 130 increases more the driving amount of the pump 76 in the idle suction (e.g., step S24 or S25) as the elapsed time is shorter. The details of the idle suction executed in step S24 or S25 may be substantially the same as the details of the idle suction executed in step S15 or step S16 of FIG. 9, and therefore, a detailed description will not be repeated. The idle suction in step S24 or S25 is an example of a first idle suction.

On condition that the idle suction (e.g., step S24 or S25) is completed, the controller 130 notifies the user of the completion of preparation for replacement of the ink tank 10 (e.g., step S22) and ends for the processing prior to replacement of the waste ink tank 110. In other embodiments, for example, the controller 130 may provide the user with a notification for instructing the user to wait to replace the waste ink tank 110 until the idle suction (e.g., step S24 or S25) is completed after the input for waste ink tank replacement is received.

Effects of Illustrative Embodiment

According to the illustrative embodiment, in the pre-operation for replacement of the waste ink tank 110, wet ink remaining in the tube 91C may be discharged into the waste ink tank 110 by the idle suction (e.g., step S24 or S25) performed prior to the replacement of the waste ink tank 110. Therefore, splatting of ink from an end of the tube 91C may be prevented or reduced when the tube 91C is removed from the connector 118. In the idle suction (e.g., step S24 or S25), the existing pump 76 is driven with being open to the atmosphere. Consequently, the idle suction may be executed without increasing a parts count of the multifunction device 10.

According to the illustrative embodiment, in the processing prior to replacement of the waste ink tank 110, the driving amount of pump 76 during the idle suction (e.g., step S24 or S25) is increased more as the elapsed time is shorter, whereby ink remaining in the tube 91C may be discharged into the waste ink tank 110 further effectively. In the illustrative embodiment, a the driving amount of the pump 76 is changed in the two levels for the idle suction (e.g., step S24 or S25). Nevertheless, the aspects of the disclosure are not limited to the above-described example. In other embodiments, for example, the driving amount of the pump 76 may be changed in three or more levels in accordance with the elapsed time.

According to the illustrative embodiment, in the processing prior to replacement of the waste ink tank 110, the idle suction (e.g., step S24 or S25) is executed while the cap 71 is located at the covering position and the suction port 93 is in communication with one of the atmosphere port 97 and the atmosphere port 98. Nevertheless, the aspects of the disclosure are not limited to the above-described example. In other embodiments, for example, in the idle suction (e.g., step S24 or S25) executed in the processing prior to replacement of the waste ink tank 110, the conveyor motor 102 may be rotated in the one direction in the state where the carriage 23 is positioned between the position A and the position B (e.g., the cap 71 is positioned in the separate position). The state of the rotary body 92 in this situation may be in any state of FIGS. 6B, 6C, and 6D.

According to the illustrative embodiment, in the processing prior to replacement of the waste ink tank 110, the notification that instructs the user to wait to replace the waste ink tank 110 and/or the notification that notifies the user of permission to replace the waste ink tank 110 are issued, thereby preventing the user from starting replacement of the waste ink tank 110 before ink remaining in the tube 91C is discharged. Consequently, the splattering of ink during the replacement of the waste ink tank 110 may be prevented or reduced further effectively.

According to the illustrative embodiment, after the waste ink tank 110 becomes in the nearly-full state in the purging processing, the idle suction (e.g., step S15) in which the driving amount of pump 76 is increased is executed, thereby further reducing the amount of ink that remains in the tube 91C at the time of replacement of the waste ink tank 110. The driving amount of the pump 76 is reduced in the idle suction (e.g., step S16) until the waste ink tank 110 becomes in the nearly-full state, thereby increasing throughput of the purging processing.

In the illustrative embodiment, the driving amount of pump 76 in the idle suction (e.g., step S15 or S16) executed in the purging processing is controlled appropriately in accordance with whether the waste ink tank is in the nearly-full state. Nevertheless, the aspects of the disclosure are not limited to the above-described example. In other embodiments, for example, the controller 130 may drive the pump 76 by a predetermined driving amount in the idle suction (e.g., step S15 or S16) executed in the purging processing, regardless of whether the waste ink tank 110 is in the nearly-full state. The controller 130 may determine whether the waste ink tank 110 is in the nearly-full state after the end of the purging processing, and may execute idle suction again when the waste ink tank 110 is in the nearly-full state.

In the illustrative embodiment, the nearly-full state of the waste ink tank 110 is detected by the detection electrode 120 and the full state of the waste ink tank 110 is detected by the calculation of the ink amount by the controller 130. Nevertheless, the aspects of the disclosure are not limited to the example described above. In other embodiments, for example, another detection electrode may be provided for detecting the full state of the waste ink tank 110, or the nearly-full state of the waste ink tank 110 may be detected by calculation of the ink amount by the controller 130. The amount of ink discharged in a single step of ink suction (e.g., step S12) may be prestored in the ROM 132 or the EEPROM 134 as a fixed amount and the fixed amount may be added up every time the ink suction (e.g., step S12) is executed. When the total of the added amount reaches the threshold ink amount, the controller 130 may determine that the waste ink tank 110 becomes the nearly-full state.

In the illustrative embodiment, the multifunction device 10 is configured to record an image onto a sheet 12. Nevertheless, the aspects of the disclosure are not limited to the above-described example. In other embodiments, for example, an image may be recorded on any other recording medium. For example, the multifunction device 10 may be configured to record an image on a surface of a compact disc ("CD") or a digital versatile disc ("DVD"). In this case, the CD or the DVD may be placed on a thin-plate-shaped medium tray and may be inserted into the multifunction device 10 via the opening 13.

While the disclosure has been described in detail with reference to the specific embodiments thereof, various changes, arrangements and modifications may be applied therein without departing from the spirit and scope of the disclosure.

What is claimed is:

1. An inkjet recording apparatus comprising:

a carriage configured to move in a main scanning direction;

a recording head mounted on the carriage and comprising a nozzle surface in which nozzles are formed, the recording head being configured to eject ink through the nozzles;

a maintenance mechanism configured to discharge the ink from the recording head, the maintenance mechanism comprising:

a cap disposed to face the carriage when the carriage is positioned in a maintenance area, the cap being configured to move between a covering position in which the cap covers the nozzle surface of the recording head and a separate position in which the cap is separate from the nozzle surface, a pump comprising an inlet and an outlet and configured to be driven to discharge the ink from the recording head through the inlet to the outlet, a tube extending from the outlet of the pump, and a waste ink storage detachably attached to an end of the tube and configured to store the ink discharged from the recording head; and a controller configured to:

drive the pump to execute purging in a state in which the inlet of the pump is in communication with the cap in the covering position, receive an input indicating replacement of the waste ink storage, determine a time elapsed after the execution of the purging until the input is received, determine whether the time elapsed is shorter than a first threshold time, and in response to determining that the time elapsed is shorter than the first threshold time, drive the pump a first driving amount to execute a first idle suction in a state in which the inlet of the pump is in communication with atmosphere.

2. The inkjet recording apparatus according to claim 1, wherein the controller is further configured to, in response to determining that the time elapsed is shorter than a second threshold time which is shorter than the first threshold time, drive the pump a second driving amount to execute the first idle suction in a state in which the inlet of the pump is in communication with the atmosphere, wherein the second driving amount is greater than the first driving amount.

3. The inkjet recording apparatus according to claim 1, wherein the maintenance mechanism further comprises a switching unit configured to, when the cap is in the covering position, be switched between a first state in which the inlet of the pump is in communication with the cap in the covering position and a second state in which the inlet of the pump is in communication with the atmosphere, and wherein the controller is configured to switch the switching unit into the first state and drive the pump to execute the purging, and configured to switch the switching unit into the second state and drive the pump to execute the first idle suction.

4. The inkjet recording apparatus according to claim 3, wherein the controller is configured to:

detect an ink amount stored in the waste ink storage, determine whether the ink amount exceeds a threshold ink amount, and switch the switching unit into the second state and drive the pump to execute a second idle suction, wherein in response to determining that the ink amount exceeds the threshold ink amount, the controller is configured to drive the pump a third driving amount to execute the second idle suction, and in response to determining that the ink amount is less than or equal to the threshold ink amount, the controller is configured to drive the pump a fourth driving amount to execute the second idle suction, wherein the third driving amount is greater than the fourth driving amount.

5. The inkjet recording apparatus according to claim 1, wherein the controller is further configured to:

detect an ink amount stored in the waste ink storage;

determine whether the ink amount exceeds a threshold ink amount; and in response to determining that the ink amount exceeds the threshold ink amount, drive the pump to execute a second idle suction in a state in which the inlet of the pump is in communication with the atmosphere.

6. The inkjet recording apparatus according to claim 1, wherein the carriage is configured to move in the main scanning direction between opposite ends of the inkjet recording apparatus, wherein the maintenance mechanism further comprises a link mechanism configured to move the cap from the separate position to the covering position in response to movement of the carriage in the main scanning direction from a first position to a second position wherein the second position is closer to one of the opposite ends of the inkjet recording apparatus than the first position, and wherein the controller is configured to drive the pump to execute the purging when the carriage is in the second position.

7. The inkjet recording apparatus according to claim 6, wherein the controller is configured to drive the pump to execute the first idle suction when the carriage is positioned between the first position and the second position.

8. The inkjet recording apparatus according to claim 1, wherein the controller is further configured to, after reception of the input, notify a user to wait to replace the waste ink storage until completion of the first idle suction.

9. The inkjet recording apparatus according to claim 1, wherein the controller is further configured to, in response to completion of the first idle suction, notify a user of permission to replace the waste ink storage.

10. The inkjet recording apparatus according to claim 1, wherein the carriage is configured to move in the main scanning direction within an image recording area when the recording head ejects the ink, and the maintenance area is outside the image recording area.

* * * * *